US006308674B1

(12) United States Patent
Ruehle et al.

(10) Patent No.: US 6,308,674 B1
(45) Date of Patent: Oct. 30, 2001

(54) CRANKING DEVICE FOR INTERNAL COMBUSTION ENGINES

(75) Inventors: Walter Ruehle, Korntal-Muenchingen; Claus Kramer, Besigheim; Wolfgang Seils, Ludwigsburg; Dieter Schramm, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/423,330

(22) PCT Filed: Jan. 8, 1999

(86) PCT No.: PCT/DE99/00021

§ 371 Date: Nov. 5, 1999

§ 102(e) Date: Nov. 5, 1999

(87) PCT Pub. No.: WO99/47808

PCT Pub. Date: Sep. 23, 1999

(30) Foreign Application Priority Data

Mar. 13, 1998 (DE) ..... 198 10 954
Nov. 10, 1998 (DE) ..... 198 51 741

(51) Int. Cl.[7] ..... F02N 11/08
(52) U.S. Cl. ..... 123/179.3; 290/38 R
(58) Field of Search ..... 123/179.1, 179.3, 123/179.25; 290/38 R; 318/430, 431

(56) References Cited

U.S. PATENT DOCUMENTS 4,418,289 * 11/1983 Mortensen ..... 290/38 R
6,104,157 * 8/2000 Kramer et al. ..... 318/430

FOREIGN PATENT DOCUMENTS 58-176465 * 10/1983 (JP) ..... 290/36 R

* cited by examiner

*Primary Examiner*—Andrew M. Dolinar
(74) *Attorney, Agent, or Firm*—Michael J. Striker

(57) ABSTRACT

The invention relates to a cranking device for internal combustion engines, having a starter motor whose starter pinion initially shifts into the gear ring of the engine with a starting signal via an engagement magnet, before the starter motor trips the cranking process with full force. The shifting of the starter pinion and the switching of the starter motor are improved by providing that the starter motor (SM) with the starting signal (st) drives the starter pinion initially via a protective resistor (Rvor) with reduced torque, and the engagement magnet (EM) shifts it into the gear ring of the engine, and that after that, the engagement magnet (EM) presses the starter pinion all the way into the gear ring of the engine, and the starter motor (SM) turns the engine over with full torque by bypassing the protective resistor (Rvor).

6 Claims, 1 Drawing Sheet

CRANKING DEVICE FOR INTERNAL COMBUSTION ENGINES

BACKGROUND OF THE INVENTION

1. Field of the Invention

The invention relates to a cranking device for internal combustion engines, having a starter motor whose starter pinion initially shifts into the gear ring of the engine with a starting signal via an engagement magnet, before the starter motor trips the cranking process with full force.

2. Description of the Related Art

A cranking device of this kind is known from German Patent DE 30 02 232 C2. In this known cranking device, the engagement magnet is fully triggered upon contact of the ignition key, so that the starter pinion strikes the gear ring of the engine with full force if it cannot be shifted in directly. This leads to wear or damage to the teeth of the two colliding parts. Furthermore, the engagement magnet controls a contact bridge which turns the starter motor on. The switching process of this contact bridge is not without problems in this kind of control.

SUMMARY OF THE INVENTION

It is the object of the invention to improve a cranking device of the type referred to at the outset in such a way that the shifting of the starter pinion into the gear ring of the engine and the switching of the starter motor are improved.

This object is attained according to the invention in that the starter motor with the starting signal drives the starter pinion initially via a protective resistor with reduced torque, and the engagement magnet shifts the pinion until it is into the gear ring of the engine, and that after that, the engagement magnet presses the starter pinion all the way into the gear ring of the engine, and the starter motor turns the engine over with full torque by bypassing the protective resistor Rvor.

For the shifting in of the starter pinion, this produces a two-staged sequence. In the first stage, the starter motor is driven at low torque via the protective resistor. Rotating the starter motor makes it easier to find a gap between teeth, and with the advancement of the starter pinion, the wear upon impact of the starter pinion with the gear ring of the engine is reduced, especially whenever a gentle preshifting is done by means of supplying limited current to the relay. In the second stage, the engagement magnet receives full current, so that the starter pinion can shift all the way into the gear ring of the engine. After that, the starter motor is supplied with full current and rotates at full torque.

In one feature, it is provided that the starting signal is delivered to a logic circuit, which via a first triggered semiconductor, for instance a highside smart FET, imposes reduced current on the series circuit comprising the protective resistor and the starter motor, and that the logic circuit, via a second triggered semiconductor, for instance a highside smart FET, triggers the engagement magnet in clocked fashion, until the starter pinion shifts into the gear ring of the engine.

In this triggering, the starter contact of the ignition key is relieved, and with the triggering of the two highside smart FETs a chronological succession can moreover be initiated, so that the reduced triggering of the starter motor can be done simultaneously with the action upon the engagement magnet, or alternatively the engagement magnet can be acted upon only after the starter motor has started up.

With the clocked triggering of the engagement magnet, the current is reduced, and thus the thermal stress is reduced.

Moreover, this achieves a gentle shifting of the starter pinion into the gear ring of the engine.

A chronological compulsory succession of the two shifting events can also be attained by providing that the second semiconductor is connected in series with the first semiconductor, and that after the shifting of the starter pinion, the second semiconductor is made fully conducting via the logic circuit.

The transition between the two stages of shifting in and switching of the starter motor can be done in controlled fashion in accordance with one feature, in that the shifting of the starter pinion into the gear ring of the engine is monitored by means of a travel sensor and is indicated to the logic circuit, and that the logic circuit, as a function of the response of the travel sensor, switches the second semiconductor from clocked operation to continuous operation.

The initiation of the second stage of the cranking process is effected in that after the starter pinion has been forced into the gear ring of the engine, the logic circuit triggers a third semiconductor, for instance a highside smart FET, which turns on a power relay, and that a contact of the power relay imposes full current on the starter motor, whereupon the third semiconductor is connected to the positive potential of the supply voltage and is connected in series with the power relay that is connected to ground. With the inclusion of a power relay, the contact bridge controlled by the engagement magnet can be omitted. The electrical control portion for the second stage of shifting in and switching of the starter motor can also be done, in a further feature, such that after the starter pinion has been forced into the gear ring of the engine, the logic circuit triggers an N-channel MOSFET, which turns on a power relay, and that a contact of the power relay imposes full current on the starter motor, whereupon the power relay is connected to the positive potential of the supply voltage and the N-channel MOSFET connected to ground is connected in series with the power relay (LR).

If in one feature it is provided that the logic circuit switches over, after a predetermined period of time, from clocked operation to continuous operation for the engagement magnet, then the logic takes on the function of purely sequence control without feedback. The prerequisite for this is that the starter pinion has always found a gap between teeth or in other words has shifted into place. With the cranking device of the invention, the structure can also be such that the starter motor, the engagement magnet, and optionally the travel sensor form a starter unit, which is separate from the electronic portion having the logic circuit, the protective resistor, the highside smart FETs or the N-channel MOSFET and the power relay, and which is connected to the electronic portion via three lines.

The electronic portion can be separate from the starter and can be placed directly in the vicinity of the battery. As a rule, the length of the line (Kl. 30), which as a rule is unprotected by a fuse, can be reduced to a minimum. The starter is without voltage outside the actual starting process, so that the risk of short-circuiting and fire is low. The environmental conditions (temperature stress, vibration acceleration, tightness with respect to leaks, etc.) for the electronic portion are also less critical at this mounting site then directly at the starter as in known cranking devices. The engagement magnet is simpler, because it need not control any contact bridge. This has an advantage in terms of space and expense and also offers the possibility of embodying the starter as a coaxial starter.

The cranking device also has the advantage of a simplified technique for connection to the starter, which requires only the terminals 50 and 45, as well as one connection for the travel sensor WS if it is present. No internal connections are needed at the starter, either. The control electronics take on the additional functions of the two-stage shifting in and the gentle preshifting and can take on additional functions as well, such as overload and excess it temperature protection.

BRIEF DESCRIPTION OF THE DRAWINGS

The invention will be described in further detail in terms of two exemplary embodiments shown in the form of circuit diagrams in the drawing. Shown are.

DETAILED DESCRIPTION OF THE INVENTION

The starting signal output by the contact of the ignition key in a motor vehicle is delivered, in the cranking device of the invention, to a logic circuit L, as indicated by st at the terminal 50*e*. The logic circuit L, for the duration of the presence of the starting signal st, outputs a control signal to the output a1, which makes the highside smart FET T1 conducting, this highside smart FET being connected to the positive potential (terminal 30) of the supply voltage U. Thus via a series circuit comprising the protective resistor Rvor and the starter motor SM, reduced current is imposed, so that the starter motor drives the starter pinion with reduced torque. At the same time or after a time lag, the logic circuit L triggers the output a2, specifically in clocked fashion. The clock pulses, via the highside smart FET T2, act on the downstream engagement magnet EM. The prerequisite in the series circuit shown is that the highside smart FET T1 is made conducting, so that the starter motor SM is rotating. In this way, the engagement magnet EM is adjusted gently, or in other words with a reduced current demand, which leads to a gentle preshifting and shifting at reduced torque of the starter pinion into the gear ring of the engine. The shifting in can be monitored by means of a travel sensor WS, such as an end switch. Once the starter pinion has shifted into the gear ring of the engine, then the travel sensor WS outputs an indication signal to the output e1 of the logic circuit L, and this signal leads to a control signal at the output a3. The highside smart FET T3 is made conducting and turns the power relay LR on, which with its contact t connects the starter motor SM directly with the positive potential of the supply voltage U and thus bypasses the protective resistor R vor and the FET T1. The starter motor SM now, via the starter pinion, drives the gear ring of the engine with full torque.

The travel sensor WS may also be omitted, if a predetermined length of time has elapsed after the initiation of the shifting via the control signal to the output a2, and if the logic circuit L at the output a3 turns the power relay LR on. The prerequisite of this compulsory control is that the shifting and engagement process be performed successfully within this time.

Figure 1:
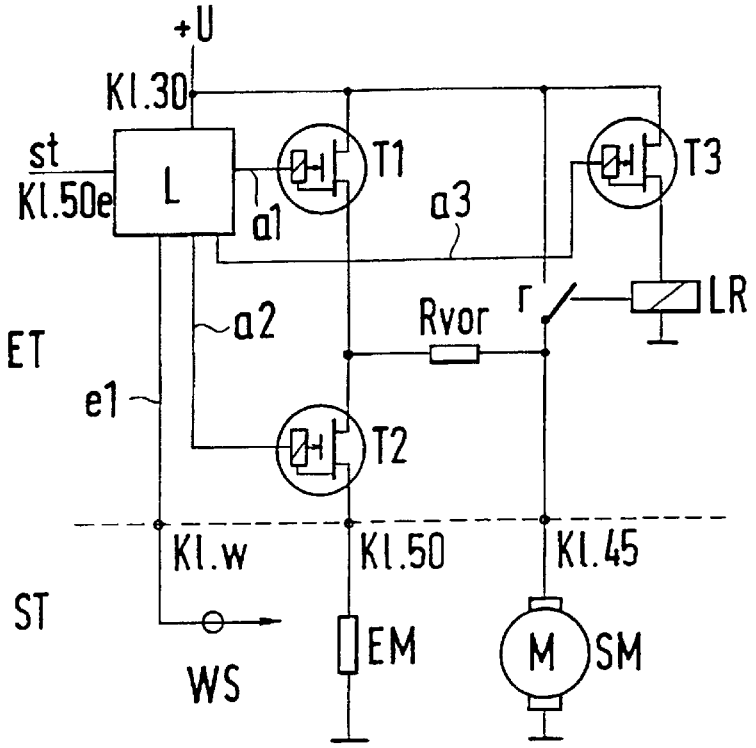
FIG. 1, a first exemplary embodiment of a cranking device with a power relay, switched via a highside smart FET, and FIG. 2, a secondary exemplary embodiment of a cranking device, with a power relay controlled via an N-channel MOSFET.

As FIG. 1 shows, the starter motor SM and the engagement magnet EM can be constructed, optionally along with the travel sensor WS, as a starter ST that is separate from the electronic portion ET. Both parts are then connected to one another via two or three lines, as applicable, and make different installation sites in the motor vehicle possible, as indicated by the terminals w, 50 and 45.

Figure 2:
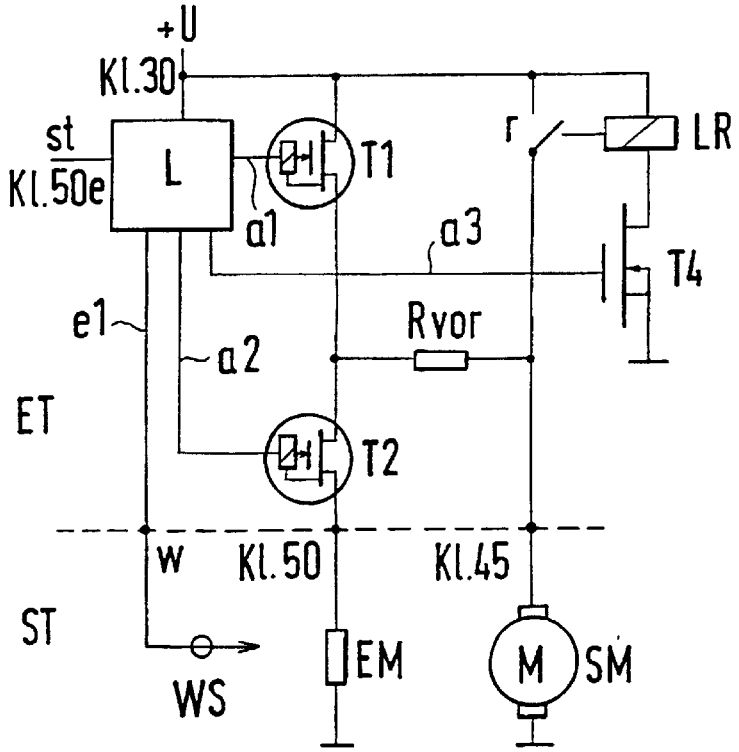

The structure of the cranking device of FIG. 2 differs from that of FIG. 1 only in the current circuit for the power relay LR, which is turned on via a less-expensive N-channel MOSFET T4. This N-channel MOSFET T4 is connected to the ground potential and is connected in series with the power relay LR that is connected to the positive potential of the supply voltage U. The triggering is done with the correct triggering potential via the output a3 of the logic circuit L.

In the circuit of FIG. 1 with the third highside smart FET T3, the triggering is done via the output a3 and with the different trigger potential required for that purpose. The highside smart FET T3 is connected to the positive potential of the supply voltage U and is connected in series with the power relay LR connected to ground potential.

The control sequence of the two cranking devices of FIGS. 1 and 2 is identical, however.

What is claimed is:

1. A cranking device for internal combustion engines, comprising a starter motor whose starter pinion initially shifts into a gear ring of the engine with a starting signal via an engagement magnet, before the starter motor trips the cranking process with full force; a logic circuit (L); a first triggered semiconductor; a second triggered semiconductor; and a protective resistor (Rvor) wherein:

the starter motor (SM) with the starting signal (st) drives the starter pinion initially via the protective resistor (Rvor) with reduced torque, and the engagement magnet (EM) shifts into the gear ring of the engine, and after the shifting, the engagement magnet (EM) presses the starter pinion all the way into the gear ring of the engine, and the starter motor (SM) turns the engine over with full torque by bypassing the protective resistor (Rvor), and wherein:

the starting signal (st) is delivered to the logic circuit (L) which via the first triggered semiconductor configured as a highside smart FET (T1), imposes reduced current on a series circuit comprising the protective resistor (Rvor) and the starter motor (SM);

the logic circuit, via the second triggered semiconductor configured as a highside smart FET (T2), triggers the engagement magnet (EM) in clocked fashion, until the starter pinion shifts into the gear ring of the engine; the second semiconductor (T2) is connected in series with the first semiconductor (T1), and after the shifting of the starter pinion, the second semiconductor (T2) is made fully conducting via the logic circuit (L).

2. The cranking device of claim 1, and further comprising a power relay (LR) and an N-channel MOSFET (T4), wherein after the starter pinion has been forced into the gear ring of the engine, the logic circuit (L) triggers the N-channel MOSFET (T4), which turns on the power relay (LR), and a contact (r) of the power relay (LR) imposes full current on the starter motor (SM), whereupon the power relay (LR) is connected to a positive potential of a supply voltage (U) and the N-channel MOSFET (T4) connected to ground is connected in series with the power relay (LR).

3. The cranking device of claim 1, wherein the logic circuit (L) switches over, after a predetermined period of time, from a clocked operation to continuous operation for the engagement magnet (EM).

4. A cranking device for internal combustion engines, comprising a starter motor whose starter pinion initially shifts into a gear ring of the engine with a starting signal via an engagement magnet, before the starter motor trips the cranking process with full force; a logic circuit (L); a first triggered semiconductor; a second triggered semiconductor; a protective resistor (Rvor), and a travel sensor wherein:

the starter motor (SM) with the starting signal (st) drives the starter pinion initially via the protective resistor (Rvor) with reduced torque, and the engagement magnet (EM) shifts into the gear ring of the engine, and after the shifting, the engagement magnet (EM) presses the starter pinion all the way into the gear ring of the engine, and the starter motor (SM) turns the engine over with full torque by bypassing the protective resistor (Rvor), and wherein:

the starting signal (st) is delivered to the logic circuit (L) which via the first triggered semiconductor configured as a highside smart FET (T1), imposes reduced current on a series circuit comprising the protective resistor (Rvor) and the starter motor (SM);

the logic circuit, via the second triggered semiconductor configured as a highside smart FET (T2), triggers the engagement magnet (EM) in clocked fashion, until the starter pinion shifts into the gear ring of the engine; the second semiconductor (T2) is connected in series with the first semiconductor (T1), and after the shifting of the starter pinion, the second semiconductor (T2) is made fully conducting via the logic circuit (L), and the shifting of the starter pinion into the gear ring of the engine is monitored by means of the travel sensor (WS) and is indicated to the logic circuit (L);

the logic circuit (L), as a function of the response of the travel sensor (WS), switches the second semiconductor (T2) from a clocked operation to continuous operation.

5. The cranking device of claim 4, and further comprising a power relay (LR) and a third semiconductor, wherein after the starter pinion has been forced into the gear ring of the engine, the logic circuit (L) triggers the third semiconductor configured as a highside smart FET (T3), which turns on the power relay (LR), and a contact (r) of the power relay (LR) imposes full current on the starter motor (SM), whereupon the third semiconductor (T3) is connected to a positive potential of a supply voltage (U) and is connected in series with the power relay (LR) that is connected to ground.

6. The cranking device of claim 5, wherein the starter motor (SM), the engagement magnet (EM), and the travel sensor (WS) form a starter unit (ST), which is separate from an electronic portion (ET) having the logic circuit (L), the protective resistor (Rvor), and one of the highside smart FETs and an N-channel (MOSFET T4) and the power relay (LR), and which is connected to the electronic portion (ET) via three lines.

* * * * *